US009085877B2

(12) United States Patent
Wahlmark et al.

(10) Patent No.: US 9,085,877 B2
(45) Date of Patent: Jul. 21, 2015

(54) SYSTEM AND METHOD FOR MAINTAINING A CROSS-SLOPE ANGLE OF A MOTOR GRADER BLADE

(75) Inventors: Christopher A. Wahlmark, Washington, IL (US); Christopher A. Padilla, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/571,529

(22) Filed: Aug. 10, 2012

(65) Prior Publication Data

US 2014/0041883 A1 Feb. 13, 2014

(51) Int. Cl.

| | |
|---|---|
| ***E02F 3/76*** | (2006.01) |
| ***E02F 3/84*** | (2006.01) |
| ***E02F 9/20*** | (2006.01) |
| ***E02F 9/26*** | (2006.01) |

(52) U.S. Cl.

CPC ..... *E02F 3/764* (2013.01); *E02F 3/765* (2013.01); *E02F 3/7645* (2013.01); *E02F 3/845* (2013.01); *E02F 3/847* (2013.01); *E02F 9/2012* (2013.01); *E02F 9/262* (2013.01)

(58) Field of Classification Search

USPC ..... 172/4.5, 780–799

See application file for complete search history.

(56) References Cited

U.S. PATENT DOCUMENTS

| | | | | | |
|---|---|---|---|---|---|
| 3,229,391 | A * | 1/1966 | Breitbarth et al. | ..... | 172/4.5 |
| 3,486,564 | A * | 12/1969 | Belke et al. | ..... | 172/4.5 |
| 3,561,538 | A * | 2/1971 | Curlett et al. | ..... | 172/4.5 |
| 4,019,585 | A * | 4/1977 | Dezelan | ..... | 172/4.5 |
| 4,024,796 | A * | 5/1977 | Theobald | ..... | 91/527 |
| 4,934,463 | A * | 6/1990 | Ishida et al. | ..... | 172/4.5 |
| 5,584,346 | A | 12/1996 | Sakamoto | | |
| 6,112,145 | A * | 8/2000 | Zachman | ..... | 701/50 |
| 6,286,606 | B1 * | 9/2001 | Krieg et al. | ..... | 172/4.5 |
| 6,295,746 | B1 | 10/2001 | Meduna | | |
| 7,588,088 | B2 | 9/2009 | Zachman | | |
| 2012/0055051 | A1 * | 3/2012 | Polston et al. | ..... | 37/427 |

* cited by examiner

*Primary Examiner* — Matthew D Troutman
(74) *Attorney, Agent, or Firm* — Leonard Stewart

(57) ABSTRACT

A blade control system for a machine. The blade control system includes an input device configured to actuate a first actuator associated with a first blade end in response to a manual command signal triggered by the input device. Further, a controller configured to receive the manual command signal indicative of the trigger initiated by the input device and actuate a second actuator associated with a second blade end with substantially same velocity as of the first actuator in response to the manual command signal.

11 Claims, 3 Drawing Sheets

SYSTEM AND METHOD FOR MAINTAINING A CROSS-SLOPE ANGLE OF A MOTOR GRADER BLADE

TECHNICAL FIELD

This patent disclosure relates generally to blade control systems, and more particularly, to system and method for maintaining a cross-slope angle of a motor grader blade.

BACKGROUND

Motor graders are used primarily as a finishing tool to sculpt a surface of the earth to a final arrangement. Typically, motor graders include a work implement, such as a surface-altering blade, that is movably connected to a front frame of the motor grader by a pair of independently controlled hydraulic actuators. The hydraulic actuators are mounted on either side of the front frame of the motor grader and operated independently, and can be extended or retracted to lower or raise the respective ends of the blade relative to the corresponding sides of the front frame. The blade height may be controlled manually or automatically.

U.S. Pat. No. 7,588,088 relates to a control system for controlling the blade position. The control system includes a first hydraulic actuator position sensor for determining the extension of the first hydraulic actuator. The control system further includes a controller that is responsive to a control input specifying a desired height and cross slope of the blade, to the first hydraulic actuator position sensor, and to an inclinometer output indicating the inclination of the blade along its length with respect to horizontal. The control provides valve control signals to a first and a second hydraulic valve to control the flow of hydraulic fluid to the first and second hydraulic actuators, which raise and lower respective ends of the blade. The control provides a first valve control signal to the first hydraulic valve in dependence upon the desired height specified by the control input, and the control provides a second valve control signal to the second hydraulic valve in dependence upon the inclinometer output, and the cross slope specified by the control input. Moreover, when the blade is to be moved upward or downward with the retraction or extension of the first actuator, the controller provides the second valve control signal to the second hydraulic valve in dependence upon the first hydraulic actuator position sensor, such that the second hydraulic actuator retracts and extends with the first hydraulic actuator, maintaining the cross slope angle of the blade as a constant.

SUMMARY

The disclosure describes, in one aspect, a blade control system for a machine. The blade control system includes an input device configured to actuate a first actuator associated with a first blade end in response to a manual command signal triggered by the input device. Further, a controller configured to receive the manual command signal indicative of the trigger initiated by the input device and actuate a second actuator associated with a second blade end with substantially same velocity as of the first actuator in response to the manual command signal.

Other features and aspects of this disclosure will be apparent from the following description and the accompanying drawings.

DETAILED DESCRIPTION

Figure 1:
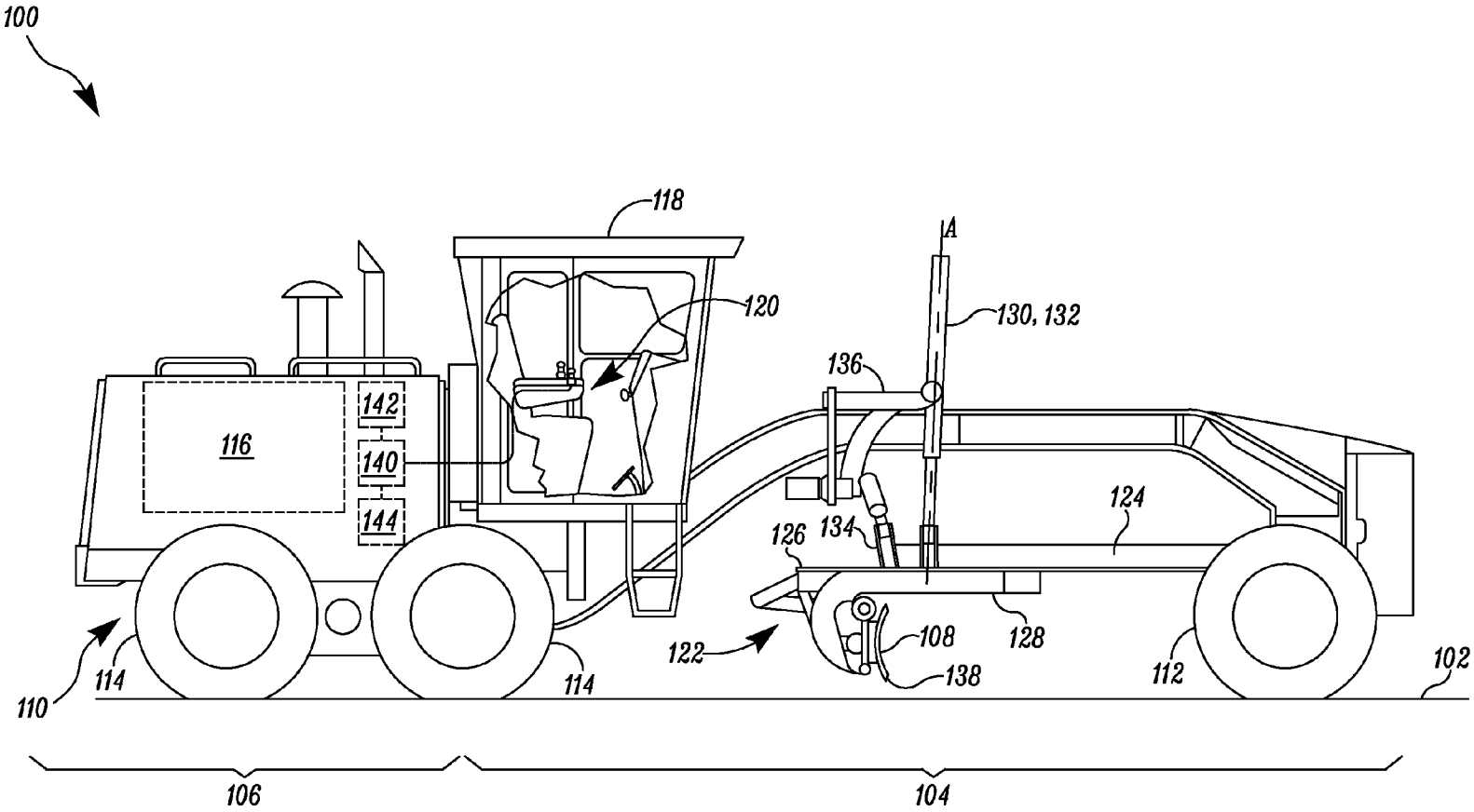
FIG. 1 is a diagrammatic side elevational view of a machine having a blade control system in accordance with an exemplary embodiment of the present disclosure.

This disclosure relates to a blade control system for maintaining a cross-slope angle of a blade. An exemplary embodiment of a machine 100 is generally shown in FIG. 1, may perform some type of operation associated with an industry such as mining, construction, farming, transportation, or any other industry known in the art. In the illustrated embodiment, the machine 100 is embodied as a motor grader 100. The machine 100 is generally used as a finishing tool to alter a surface of terrain or earth 102 to a final arrangement or contour. The motor grader 100 includes a front frame 104, a rear frame 106, and a blade 108. The front 104 and rear 106 frames are supported by wheels 110, which include a pair of front wheels 112 and two pairs of rear wheels 114 (only one side shown). The wheels 110, 112, 114 may be adapted for steering and maneuvering the motor grader 100 and for propelling the motor grader 100 in forward and reverse directions.

In the illustrated embodiment, the motor grader 100 further includes a power source 116 such as an engine, and an operator station or cab 118. The power source 116 may power a drive system (not shown) that may include the front wheels 112 and the rear wheels 114. The power source 116 may embody, for example, a diesel engine, a gasoline engine, a gaseous fuel-powered engine, or any other type of combustion engine known in the art. It may be contemplated that the power source 116 may alternatively embody a non-combustion source of power such as, for example, a fuel cell, a power storage device, or another suitable source of power. The power source 116 may produce mechanical or electrical power output, that may be converted to hydraulic power. The power source 116 is mounted on the rear frame 106.

The cab 118 may include controls necessary to operate the motor grader 100, such as, for example, one or more input devices 120 for propelling the motor grader 100, controlling the blade 108 and/or for controlling other components associated with the motor grader 100. The input devices 120 may include one or more devices embodied as joysticks, levers, pedals, user interfaces, displays etc., and may be adapted to receive input from an operator indicative of a desired movement for the blade 108 or the motor grader 100. The cab 118 is mounted on the front frame 104.

In an embodiment, the blade 108 is operatively coupled to a drawbar/moldboard/circle (DMC) assembly 122, which includes a drawbar 124, a moldboard 126, and a circle 128. The blade 108 may be coupled to the circle 128 and the circle 128 may be rotatably coupled to the moldboard 126. The moldboard 126 may be coupled to the drawbar 124. In some embodiments, the blade 108 may be fixedly coupled to the circle 128. The circle 128 may rotate about an axis A, which may, in turn, cause the blade 108 to rotate about the axis A. The circle 128 is rotated by a hydraulic motor or circle drive (not shown). The drawbar 124 may be coupled to the front frame 104 of the motor grader 100 such that the position of the drawbar 124 may be controlled by hydraulic actuators coupled to the front frame 104, such as, for example, a pair of actuators 130, 132 (a first actuator 130 and a second actuator 132, respectively) and a shift actuator 134.

The first and the second actuators 130, 132 and the shift actuator 134 are coupled to the front frame 104 using a moveable coupling 136 that may be moved during the repositioning of the blade 108. As it will be apparent to a person having ordinary skill in the art that, the first and the second actuators 130, 132 may be controlled independently, for example, to angle a bottom edge or cutting edge 138 of the blade 108 relative to the surface of the earth 102. Further, the blade 108 may be raised or lowered to adjust a height of the blade 108 relative to the surface of the earth 102. Still further, the blade 108 may be adjusted to change or maintain a cross-slope of the blade 108 by the first and the second actuators 130, 132. Moreover, the shift actuator 134 may be controlled to side shift the drawbar 124.

The motor grader 100 may further include a blade control system 140 operatively connected to the input devices 120 and to the hydraulic actuators 130, 132, 134 for controlling the movement of the blade 108. The blade control system 140 may direct the blade 108 to move to a predetermined or target position in response to an operator's desired movement of the blade 108 for engaging the blade 108 with the surface of the earth 102. The blade control system 140 may also direct the blade 108 to move to a target position in response to an automatically determined movement of the blade 108 by, based in part on, for example, an engineering or site design 142 and one or more position sensors 144. The position sensors 144 operatively connected to or associated with the motor grader 100 to determine the location of the motor grader, which may include a laser or GPS based position sensor.

The blade control system 140 may include one or more control modules (e.g. ECMs, ECUs, etc.). The one or more control modules may include processing units, memory, sensor interfaces, and/or control signal interfaces (for receiving and transmitting signals). The processing units may represent one or more logic and/or processing components used by the blade control system 140 to perform certain communications, control, and/or diagnostic functions. For example, the processing units may be adapted to execute routing information among devices within and/or external to the blade control system 140.

Further, the processing units may be adapted to execute instructions, including from a storage device, such as memory. The one or more control modules may include a plurality of processing units, such as one or more general purpose processing units and or special purpose units (for example, ASICs, FPGAs, etc.). In certain embodiments, functionality of the processing unit may be embodied within an integrated microprocessor or microcontroller, including integrated CPU, memory, and one or more peripherals. The memory may represent one or more known systems capable of storing information, including, but not limited to, a random access memory (RAM), a read-only memory (ROM), magnetic and optical storage devices, disks, programmable, erasable components such as erasable programmable read-only memory (EPROM, EEPROM, etc.), and nonvolatile memory such as flash memory.

Figure 2:
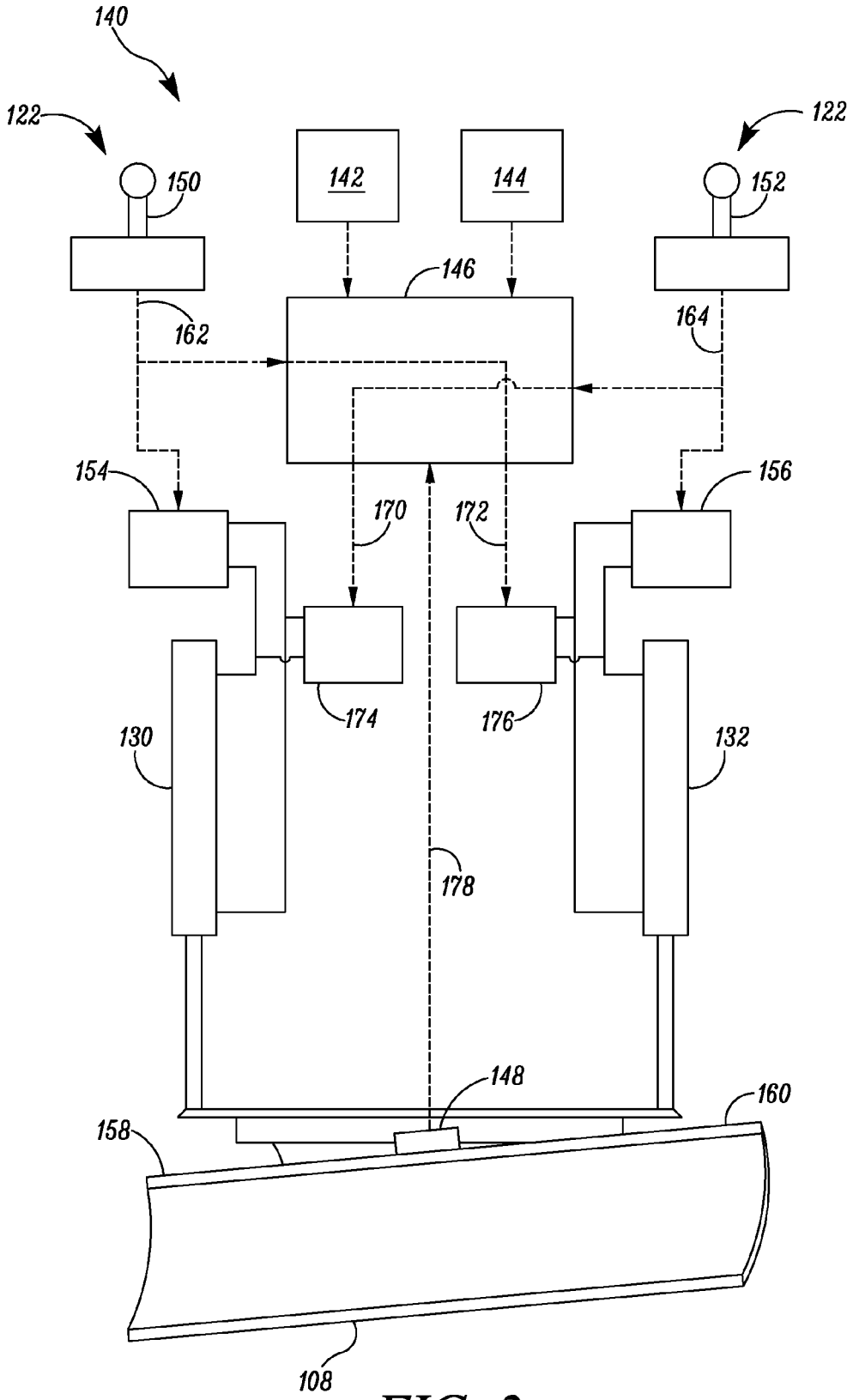
FIG. 2 is a block diagram of the blade control system for controlling a height of a blade of the machine in accordance with an exemplary embodiment of the present disclosure.

The blade control system 140 may be adapted to control or direct the movement of the blade 108 based on at least in part on the inputs received from the input devices 120, the site design 140, and the position sensors 144. FIG. 2 illustrates a block diagram of the blade control system 140, according to an embodiment of the present disclosure. The blade control system 140 may include a controller 146 configured to receive inputs from the input devices 120, the site design 142, and the position sensors 144. The controller 146 is also adapted to receive an input from an inclinometer 148 mounted on the blade 108 which is indicative of an inclination with respect to horizontal of the blade 108 along its length.

According to an embodiment of the present disclosure, the input devices 122 may include a first input device 150 and a second input device 152 located in the cab 118 of the motor grader 100. The first and the second input devices 150, 152 may include control levers, joysticks, buttons, switches etc. The first and the second input devices 150, 152 are operatively connected to first and second manually actuable control valves 154, 156 respectively. Each of the first and the second manually actuable control valves 154, 156 are connected between a hydraulic fluid supply (not shown) and the first and the second actuators 130, 132 respectively. A trigger from each of the first and the second input devices 150, 152 allows hydraulic fluid to flow under pressure through the first and the second manually actuable control valves 154, 156 to independently move the first and the second actuators 130, 132 associated with a first blade end 158 and a second blade end 160, respectively. In an embodiment, the first and the second actuators 130, 132 may adjust an elevational position of corresponding to the first blade end 158 or the second blade end 160 via the first or the second manually actuable control valves 154, 156 in response to a first manual command signal 162 or a second manual command signal 164 based on the trigger received from the first and the second input devices 150, 152, respectively.

According to an embodiment of the present disclosure, a single manual command signal (either of the first or the second manual command signals 162, 164) is used in conjunction with the controller 146 to control the movement of both the first and the second actuators 130, 132 simultaneously with substantially same velocity. As illustrated in FIG. 2, the first and the second input devices 150, 152 are operatively connected to the controller 146. Based on an input from an operator, the controller 146 is configured to process either of the second or the first manual command signals 164, 162 and provide a valve control signal (a first valve control signal 170 or a second valve control signal 172, respectively) to a first electrically actuable control valve 174 or a second electrically actuable control valve 176 that are operatively connected to the controller 146. The first and the second electrically actuable control valves 174, 176 are provided in a parallel connection to the first and the second manually actuable control valves 154, 156, respectively. Each of the first and the second electrically actuable control valves 174, 176 are also connected between the hydraulic fluid supply and the first and the second actuators 130, 132, respectively. The first and the second actuators 130, 132 may also adjust an elevational position of corresponding to the first blade end 158 and the second blade end 160 via the first and the second electrically actuable control valves 174, 176 in response to the first and the second valve control signals 170, 172 based on the first and the second manual command signals 162, 164.

In an exemplary embodiment, the trigger by the first input device 150 may actuate the first manually actuable control valve 154 to move the first blade end 158 to the desired elevational position in response to the first manual command 162. The controller 146 may simultaneously receive and processes the first manual command signal 162 corresponding to the trigger by the first input device 150 to provide the second valve control signal 172 to the second electrically actuable control valve 176 to move the second blade end 160 with same velocity. However, in another embodiment, the first and the second electrically actuable control valves 174, 176 are also operable independently from the first and the second manually actuable control valves 154, 156.

In an embodiment of the present disclosure, the control valves 150, 152, 174, and 176 are solenoid operated proportional valves. Based on the voltage and current applied to the solenoid operated proportional valves 150, 152, 174, and 176 the input devices 120 or the controller 146 can control the movement and speed of the first and the second actuators 130, 132. In accordance with an embodiment of the present disclosure, the controller 146 may further include electric sensors or calibration maps associated with the solenoid operated proportional valves 150, 152, 174, and 176. The controller 146 is configured to control velocity of the first and the second actuators 130, 132 with same magnitude in response to the second or the first manual command signals 164, 162. It will be apparent to a person having ordinary skill in the art that the synchronization of the first and the second actuators 130, 132 is based on a relative calibration of the solenoid operated proportional valves 150, 152, 174, and 176.

INDUSTRIAL APPLICABILITY

The industrial applicability of the systems and methods for maintaining the cross-slope angle of a blade described herein will be readily appreciated from the foregoing discussion. Although the machine 100 shown as the motor grader 100, any type of machine that performs at least one operation associated with, for example, mining, construction, and other industrial applications may embody the disclosed systems and methods. The machine 100 may also be associated with non-industrial uses and environments, such as, for example, cranes, earthmoving vehicles, backhoes, and/or material handling equipment. Moreover, the systems and methods described herein can be adapted to a large variety of machines and tasks.

Normally, the operator may control the elevation position of the blade 108 using the first and the second input devices 150, 152. Each of the first and the second input devices 150, 152 modulates the respective first and the second manually actuable control valves 154, 156 to achieve a desired elevational position of the blade 108 at the first blade end 158 or the second blade end 160, respectively. Conventionally, whenever the operator actuates one of the first or the second manually actuable control valves 150, 152 to move the first blade end 158 or the second blade end 160. Successively, the other blade end is moved by the controller 146 in response to the inclinometer output 178, from the inclinometer 148, and a desired cross-slope provided by the site design 142 and position sensors 144.

Typically, the inclinometer 148 is mechanically or electrically damped to absorb any rapid fluctuations and signal noise in the output that would otherwise result from vibration in the motor grader 100. This damping may produce a time delay in the inclinometer output 178 in the motor grader 100 that degrades the operation of the blade control system 140 when a change in the elevation of the blade is to be effected. The time delay, caused by the damping of the inclinometer 148, during the lowering or raising the blade 108 is significant before the inclinometer 148 provide an output indicating a change in inclination. The first and the second actuators 130, 132 that are controlled manually or automatically are required to extend or retract simultaneously in order to maintain the desired cross-slope.

As described above, the trigger by the first input device 150 may actuate the first manually actuable control valve 154 to move the first blade end 158 to the desired elevational position in response to the first manual command 162. Further, the controller 146 may receive and processes the first manual command signal 162 corresponding to the trigger by the first input device 150 to provide the second valve control signal 172 to the second electrically actuable control valve 176 to simultaneously move the second blade end 160 with same velocity. Thus, maintain the cross-slope of the blade 108 while moving to the desired elevational position. It will be understood that, while the trigger by the second input device 152 actuates the second manually actuable control valve 156 to move the second blade end 160 to the desired elevational position, the first electrically actuable control valve 174 also move the first blade end 158 via the controller 146 to maintain the cross-slope of the blade 108.

Figure 3:
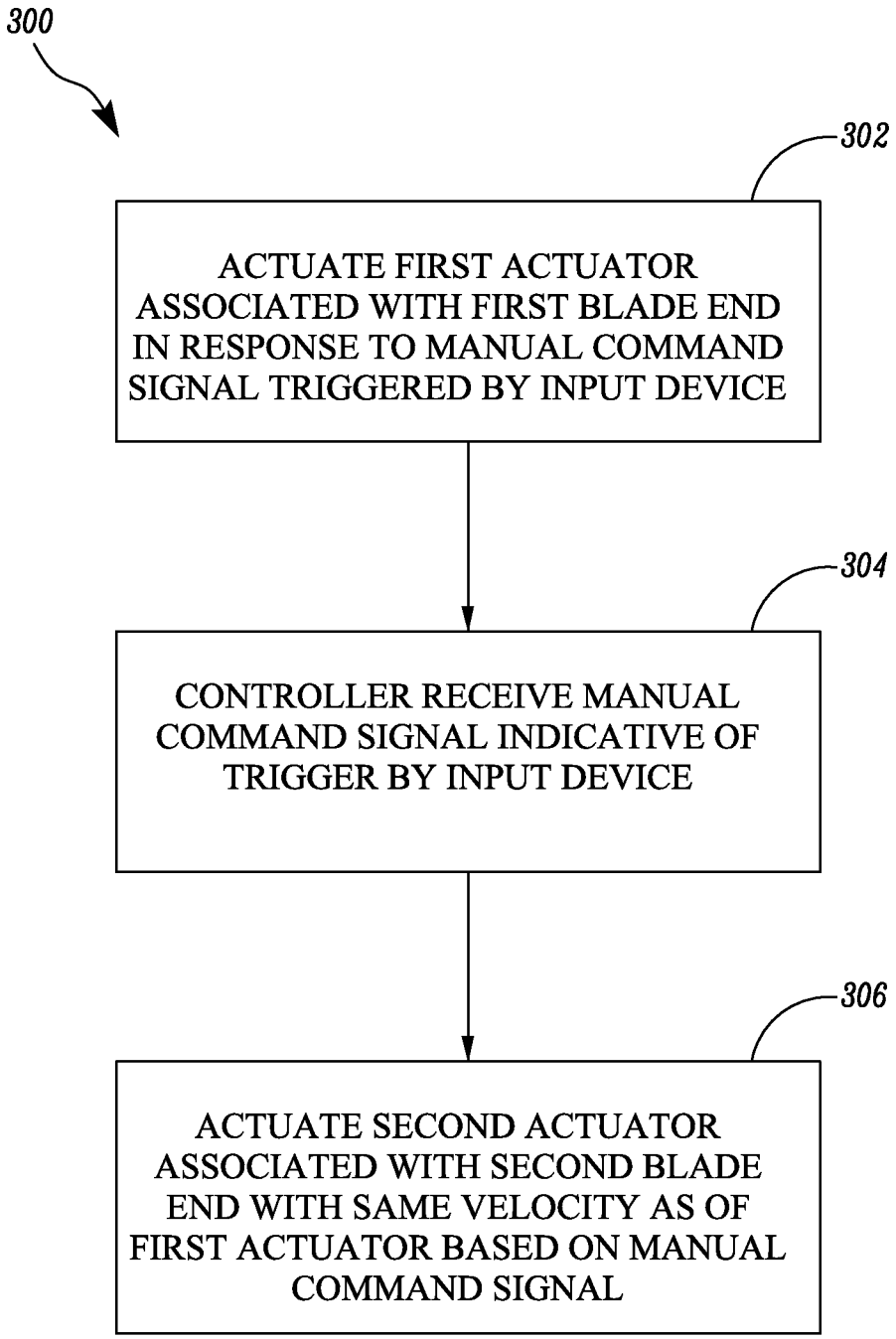
FIG. 3 is a flow diagram illustrating an exemplary method for maintaining a cross-slope angle of the blade.

FIG. 3. illustrates a flow diagram illustrating an exemplary method 300 for controlling the blade 108. In an exemplary embodiment, at step 302, the first actuator 130 associated with the first blade end 158 is actuated in response to first manual command signal 162 initiated by the trigger from the first input device 150. The controller 146 receives the first manual command signal 162 indicative of the trigger from the first input device 150 at step 304. The controller 146 processes the first manual command signal 162 to generates and send the second valve control signal 172 to the second electrically actuable valve 176. Finally, at step 306, the second actuator 132 associated with the second blade end 160 is simultaneously moved with substantially same velocity as of the first actuator 130 by the second electrically actuable valve 176 in response to second valve control signal 172 based on the first manual command signal 162. Thus, maintaining the desired cross-slope of the blade 108 by simultaneously moving the first blade end 158 and the second blade end 160 with same velocity based on the first manual command signal 162.

Although the embodiments of this disclosure as described herein may be incorporated without departing from the scope of the following claims, it will be apparent to those skilled in the art that various modifications and variations can be made. Other embodiments will be apparent to those skilled in the art from consideration of the specification and practice of the disclosure. It is intended that the specification and examples be considered as exemplary only, with a true scope being indicated by the following claims and their equivalents.

We claim:

1. A blade control system for a machine, the blade control system comprising:

an input device configured to actuate a first actuator associated with a first blade end in response to a manual command signal triggered by the input device, the input device includes a first input device and a second input device;

a controller configured to receive the manual command signal indicative of the trigger by the input device and actuate a second actuator associated with a second blade end with substantially same velocity as of the first actuator in response to the manual command signal;

a manually actuable control valve operatively connected to the input device and configured to move the first actuator in response to the manual command signal based on the trigger from the input device, the manually actuable control valve includes a first manually actuable control valve and a second manually actuable control valve operatively connected with the first input device and the second input device, respectively, the first manually actuable control valve and the second manually actuable control valve configured to move the first actuator and the second actuator in response to a first manual command signal and a second manual command signal based on the trigger from the first input device and the second input device, respectively; and an electrically actuable control valve operatively connected to the controller and configured to move the second actuator in response to a valve control signal based on the manual command signal.

2. The blade control system of claim 1, wherein the controller configured to receive the first manual command signal and the second manual command signal input signal triggered by the first input device and the second input device, respectively.

3. The blade control system of claim 2, wherein the electrically actuable control valve includes a first electrically actuable control valve and a second electrically actuable control valve operatively connected with the controller, and configured to move the first actuator and the second actuator in response to a first valve control signal and a second control signal based on the second manual command signal and the first manual command signal, respectively.

4. The blade control system of claim 3, wherein the first manually actuable control valve and the first electrically actuable control valve are connected in parallel.

5. The blade control system of claim 3, wherein the second manually actuable control valve and the second electrically actuable control valve are connected in parallel.

6. A machine comprising:

a frame;

a blade is operatively couple to the frame via a first actuator and a second actuator; and a blade control system including:

an input device configured to actuate a first actuator associated with a first blade end in response to a manual command signal triggered by the input device, the input device includes a first input device and a second input device;

a controller configured to receive the manual command signal indicative of the trigger by the input device and actuate a second actuator associated with a second blade end with substantially same velocity as of the first actuator in response to the manual command signal;

a manually actuable control valve operatively connected to the input device and configured to move the first actuator in response to the manual command signal based on the trigger from the input device, the manually actuable control valve includes a first manually actuable control valve and a second manually actuable control valve operatively connected with the first input device and the second input device, respectively, the first manually actuable control valve and the second manually actuable control valve configured to move the first actuator and the second actuator in response to a first manual command signal and a second manual command signal based on the trigger from the first input device and the second input device, respectively; and an electrically actuable control valve operatively connected to the controller and configured to move the second actuator in response to a valve control signal based on the manual command signal.

7. The machine of claim 6, wherein the controller configured to receive the first manual command signal and the second manual command signal input signal triggered by the first input device and the second input device, respectively.

8. The machine of claim 7, wherein the electrically actuable control valve includes a first electrically actuable control valve and a second electrically actuable control valve operatively connected with the controller, and configured to move the first actuator and the second actuator in response to a first valve control signal and a second control signal based on the second manual command signal and the first manual command signal, respectively.

9. The machine of claim 8, wherein the first manually actuable control valve and the first electrically actuable control valve are connected in parallel.

10. The machine of claim 9, wherein the second manually actuable control valve and the second electrically actuable control valve are connected in parallel.

11. A method for controlling a blade in a machine comprising:

actuating a first actuator associated with a first blade end in response to a manual command signal triggered by an input device; the manual command signal received by a manually actuable control valve operatively connected to the input device to move the first actuator; the input device including a first input device and a second input device, the manually actuable control valve including a first manually actuable control valve and a second manually actuable control valve operatively connected with the first input device and the second input device, respectively, the first manually actuable control valve and the second manually actuable control valve configured to move the first actuator and the second actuator in response to a first manual command signal and a second manual command signal based on the trigger from the first input device and the second input device, respectively;

receiving the manual command signal indicative of the trigger by the input device by a controller;

receiving a valve control signal based on the manual command signal by an electrically actuable control valve operatively connected to the controller to move the second actuator; and actuating a second actuator associated with a second blade end with substantially same velocity as of the first actuator based on the manual command signal.

* * * * *